US007494118B2

(12) United States Patent
Peier

(10) Patent No.: US 7,494,118 B2
(45) Date of Patent: Feb. 24, 2009

(54) ARRANGEMENT FOR GATHERING AND TRANSPORTING PRINT PRODUCTS DEPOSITED STRADDLING ON A CONVEYING DEVICE

(75) Inventor: Thomas Peier, Zofingen (CH)

(73) Assignee: Müller Martini Holding AG, Hergiswil (CH)

( * ) Notice: Subject to any disclaimer, the term of this patent is extended or adjusted under 35 U.S.C. 154(b) by 155 days.

(21) Appl. No.: 11/410,974

(22) Filed: Apr. 26, 2006

(65) Prior Publication Data

US 2006/0237890 A1 Oct. 26, 2006

(30) Foreign Application Priority Data

Apr. 26, 2005 (EP) ..... 05405317

(51) Int. Cl.
*B65H 29/00* (2006.01)

(52) U.S. Cl. ..... 270/52.26; 270/52.14; 270/52.16; 270/52.18; 270/52.29; 198/604; 198/605

(58) Field of Classification Search ..... 270/52.14, 270/52.16, 52.18, 52.26, 52.29; 198/604, 198/605

See application file for complete search history.

(56) References Cited

U.S. PATENT DOCUMENTS 4,770,284 A 9/1988 Boss
5,678,813 A * 10/1997 Osako et al. ..... 270/52.16
5,820,335 A * 10/1998 Croteau et al. ..... 414/788.3
6,315,107 B1 11/2001 Müller et al.
6,776,412 B2 * 8/2004 DaCunha et al. ..... 271/274

FOREIGN PATENT DOCUMENTS

DE 42 03 848 A1 8/1993
DE 4203848 A1 * 8/1993
EP 0 062 618 A2 10/1982
EP 1 232 978 A1 8/2002

OTHER PUBLICATIONS

Search Report from EP 05 40 5317, dated Sep. 6, 2005.

* cited by examiner

*Primary Examiner*—Gene Crawford
*Assistant Examiner*—Leslie A Nicholson, III
(74) *Attorney, Agent, or Firm*—Venable LLP; Robert Kinberg; Steven J. Schwarz

(57) ABSTRACT

An arrangement for gathering and transporting print products, deposited straddling on a conveying device, includes a first conveying device including a first double chain having first and second strands and a second conveying device including a second double chain having first and second strands. A transfer region is provided in which the print products are transferred from the first conveying device to the second conveying device. The first and second double chains overlap in the transfer region such that the print products are transported in the transfer region with the aid of one strand on the first double chain and one strand on the second double chain.

10 Claims, 3 Drawing Sheets

ARRANGEMENT FOR GATHERING AND TRANSPORTING PRINT PRODUCTS DEPOSITED STRADDLING ON A CONVEYING DEVICE

CROSS-REFERENCE TO RELATED APPLICATION

This application claims the priority of European Patent Application No: 05405317.8, filed on Apr. 26, 2005, the subject matter of which is incorporated herein by reference.

BACKGROUND OF THE INVENTION

The invention relates to an arrangement for gathering and transporting print products, deposited straddling, on a conveying device, in which the arrangement includes a first conveying device with a first double chain and a second conveying device with a second double chain, as well as a transfer region in which the print products can be transferred from the first conveying device to the second conveying device.

An arrangement of this type is disclosed in European patent document EP 1 232 978 A. This arrangement is provided with a first conveying device in the form of a first gathering and stitching machine and a second conveying device in the form of a second gathering and stitching machine, wherein the two gathering and stitching machines are arranged successively as seen in conveying direction. With the aid of an intermediate conveying element, partial products can be transported from the first gathering and stitching machine to the second gathering and stitching machine. The intermediate conveying element is provided with a timed transporter, provided with several grippers, which respectively grip the fold on the top of each partial product and transport the product across the distance between the two gathering and stitching machines. With this type of arrangement, the two gathering and stitching machines can be operated either separately or jointly, in a so-called tandem operation. The first gathering and stitching machine is also referred to as "slave" and, as a rule, comprises a stitching machine. Following the stitching operation, the print products can be either supplied to the second gathering and stitching machine and/or the "master," or they can be transferred out, for example supplied to a cutting or trimming machine. The print products are transported in both gathering and stitching machines with the aid of a double gathering chain and a ridge arranged between the two strands.

Also known is an arrangement for which the intermediate conveying element between the two gathering chains is embodied as a simple chain. In that case, the ridge between the two gathering chains is interrupted, meaning not continuous, which can lead to interruptions during the transfer and can also result in production jams. In particular, the products can slide off toward the side during the transfer.

SUMMARY OF THE INVENTION

It is an object of the present invention to provide an arrangement of the aforementioned type which results in a safer operation, but does not require a higher structural expenditure.

The above and other objects are accomplished according to the invention wherein in one exemplary embodiment there is provided an arrangement for gathering and transporting print products, deposited straddling on a conveying device, comprising: a first conveying device including a first double chain having first and second strands; a second conveying device including a second double chain having first and second strands; and a transfer region in which the print products are transferred from the first conveying device to the second conveying device; wherein the first and second double chains overlap in the transfer region such that in the transfer region the print products are transported with the aid of one strand on the first double chain and one strand on the second double chain.

The transfer region for the arrangement according to the invention is consequently formed with the aid of one strand from the first double chain and one strand from the second double chain. An essential advantage of the invention is that the print products always rest on a continuous ridge, even in the transfer region. That is, the ridge which the print products straddle is not interrupted in the transfer region. A stable, mostly uninterrupted transport of the products is thus always possible, even in the transfer region. The arrangement according to the invention furthermore also has a simpler design because a comparatively more involved, timed transporter with several grippers is not required. Also rather than using an additional single gathering chain in the transfer region, in the present invention the two double chains already on the two gathering and stitching machines form the transfer region. In addition, the drive system is also simplified considerably.

Another advantage of the invention is that the strands of the double chains can respectively be tensioned and adjusted separately and thus optimally.

According to a modification of the invention, a continuous guide for conveying the print products is provided in the transfer region, on which the products are deposited straddling and are conveyed in the conveying direction. The aforementioned ridge preferably functions as the guide, which extends advantageously between the two strands from the first gathering and stitching machine to the second gathering and stitching machine. In the first gathering and stitching machine, the ridge can be interrupted, in a manner known per se, in the region of the stitching machine.

According to one modification of the invention, the aforementioned strands are each provided with carriers in the transfer region, wherein the strands are embodied such that the print products are transported by respectively one carrier from the one strand and one carrier from the other strand. The print products can thus be transported even in the transfer region by respectively two carriers, in the standard manner, which results in a particularly high operational safety.

In the transfer region, the two aforementioned strands preferably extend parallel to each other.

According to a another modification of the invention, one strand of the double chain from the first conveying device is deflected forward the transfer region (with respect to the direction of conveyance) by a deflection pulley or drive wheel. This strand is provided with carriers that can be pivoted toward the back in the region of the aforementioned deflection pulley and/or drive wheel, as seen in the conveying direction, thereby permitting a particularly careful transport of the print products in the transfer region and/or at the start of this region.

BRIEF DESCRIPTION OF THE DRAWINGS

The above and other features and advantages of the invention will be further understood from the following detailed description of the exemplary embodiments with reference to the accompanying drawings.

DETAILED DESCRIPTION OF THE INVENTION

Figure 1:
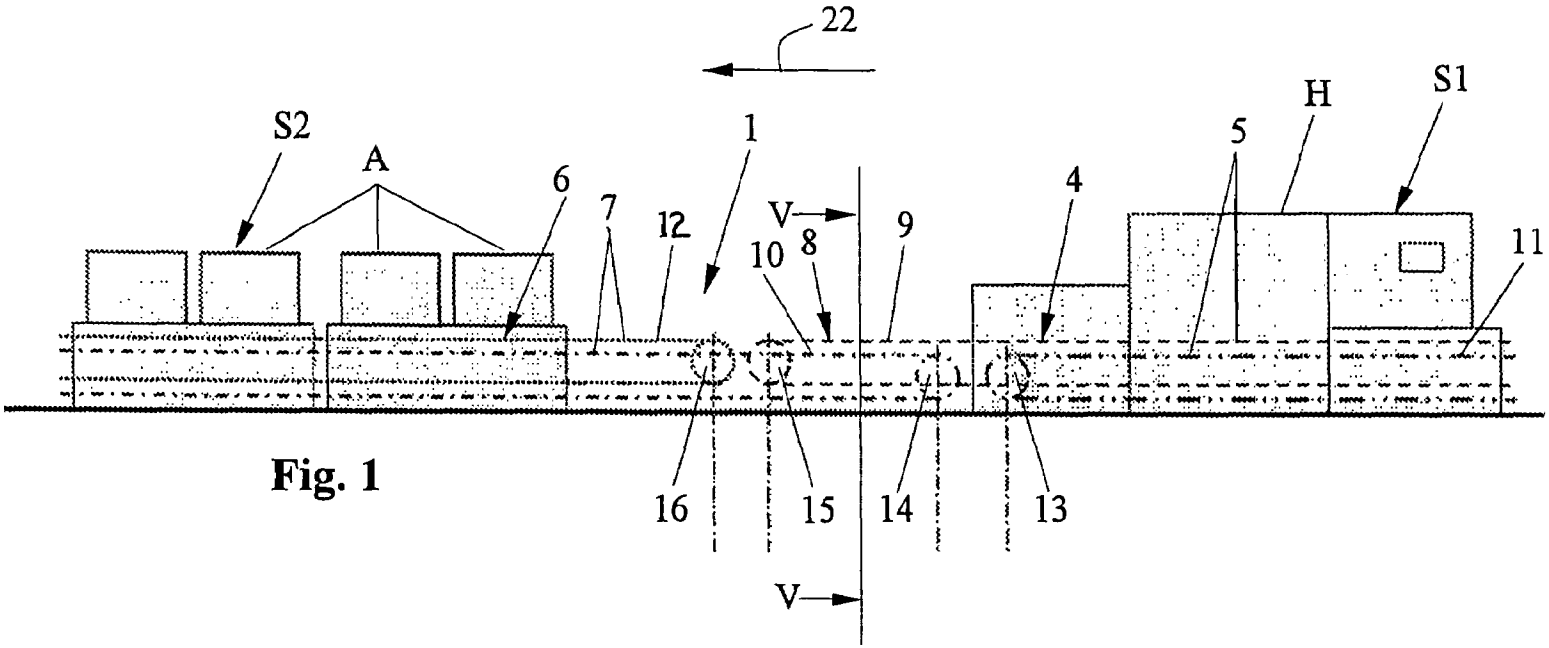
FIG. 1 shows a schematic view from the side of an arrangement according to the invention.
Figure 2:
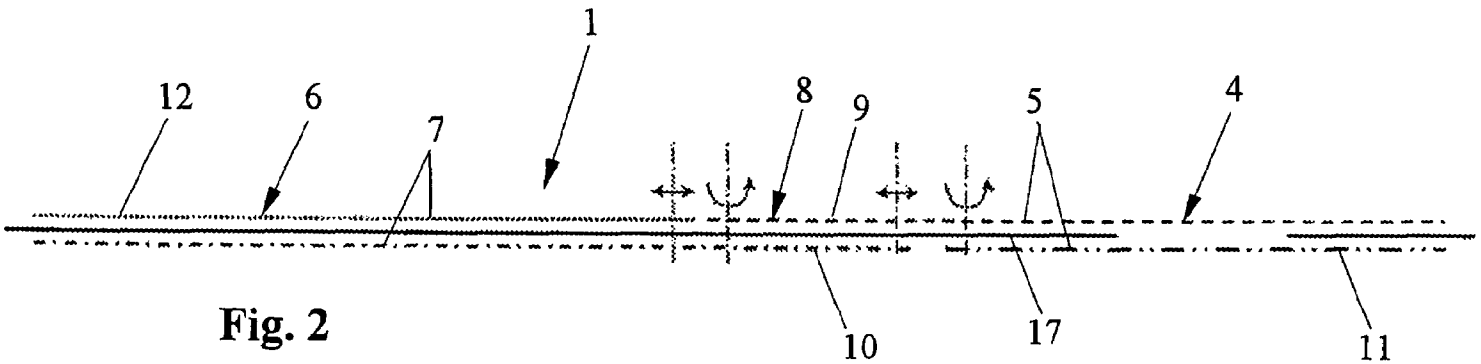
FIG. 2 shows a schematic view from above of the arrangement according to FIG. 1.

Referring to FIGS. 1 and 2, there is shown an arrangement 1 according to the invention, which comprises a first gathering and stitching machine S1 and a second gathering and stitching machine S2, connected by a transfer region 8. The first gathering and stitching machine S1 comprises a conveying device 4 with a first double chain 5. This first double chain 5 has two parallel extending chain strands 9 and 11, as shown in FIG. 2. A ridge 17 extends between these two strands 9 and 11, wherein this ridge is interrupted in the region of a gathering and stitching machine H, as can be seen. However, ridge 17 is continuous and thus not interrupted in the transfer region 8. The dash-dot lines showing the strands 9 and 11 are shown offset in height, but only for reasons of illustration. The gathering and stitching machine S2 is provided with feeders A which are known per se and can be used for depositing additional printed sheets, signatures, or other print products. The gathering and stitching machine can furthermore comprise additional operating units such as stitching and cutting or trimming machines.

Figure 5:
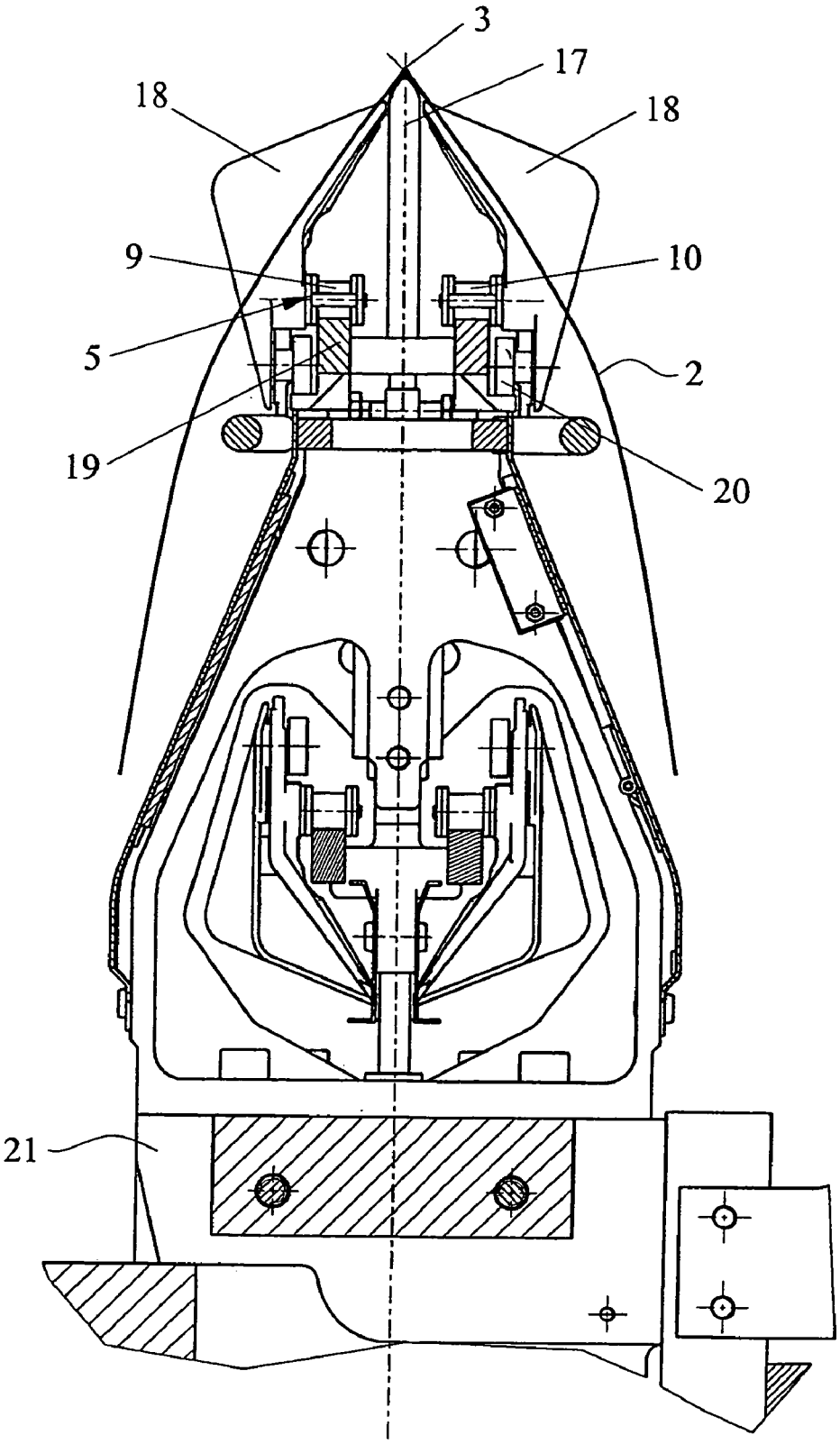
FIG. 5 shows a sectional view along the line V-V in FIG. 1.

According to FIG. 5, the ridge 17 forms a guide for print products 2, in a manner known per se, wherein the products are transported from the first conveying device 4 via the transfer region 8 to the second conveying device 6. In FIG. 1, the direction of transport is indicated with arrow 22. The two double chains 5 and 7 are respectively provided with uniformly spaced-apart wing-shaped carriers 18, as shown in FIG. 5. The carriers are respectively attached to one strand of each double chain, for example the strands 9 and 10, respectively, and are guided on rollers 20. The strands 9 and 10 are guided on a chain guide 19 and, in particular, are endless open-link chains. FIG. 5 shows that each of the conveyed print products 2 is provided with a fold 3 with which they rest straddling on the ridge 17, as can be seen. The ridge 17 is locally fixed and attached to a support 21.

According to FIGS. 1 and 2, the strand 11 on the first double chain 5 ends forward the transfer region 8 (with respect to the direction of conveyance shown by arrow 22) and is guided over a drive wheel 13. The other strand 9, in contrast, extends into the transfer region 8 and is fitted over a drive wheel 15 at the end of the transfer region 8. The two strands 9 and 11 are driven with uniform speed and the same timing, and the upper belt section always moves in the direction of arrow 22. The carriers 18 on these two strands 9 and 11 are respectively positioned in the same plane. The print products 2 are thus always transported with the aid of one carrier on the strand 9 and one carrier on the strand 11.

The second conveying arrangement 6 is provided with a strand 10 and a strand 12. The strand 10 also extends into the transfer region 8, but from the other side. The strand 10 is fitted around a deflection pulley 14 at the start of the transfer region 8. The deflection pulley 14 is connected to a chain-tensioning device, not shown herein. The strand 12 ends forward the transfer region 8 (in the direct of conveyance) and is also fitted around a deflection pulley 16, wherein this deflection pulley 16 is also connected to a chain-tensioning device that is not shown herein. The strands 10 and 12 can therefore be tensioned separately and can be adjusted to the optimum tension. The same is true for the remaining strands. The two double chains 5 and 7 therefore overlap in the transfer region 8 so that in the transfer region 8, the strand 9 of the first double chain 5 and the strand 10 of the second double chain 7 transport the print products 2. As a result, a type of double chain is formed in the transfer region 8, which provides a stable transport of the print products 2 with the aid of carriers 18 and the ridge 17 in the transfer region 8.

The print products 2 can thus be conveyed straddling in the region of the first gathering and stitching machine S1 and in the transfer region 8, and can be conveyed securely and straddling in the region of the second gathering and stitching machine S2. In the transfer region 8, the print products 2 can be transported either pre-stitched or unstitched. It is furthermore possible that the print products 2 are not conveyed to the transfer region 8, but are transferred out before arriving at this region, for example to a cutting device not shown herein, such as a three-way trimmer. The two gathering and stitching machines S1 and S2 can also be operated separately, as previously mentioned. In that case, the transfer region 8 is also not used for the transport.

Figure 3:
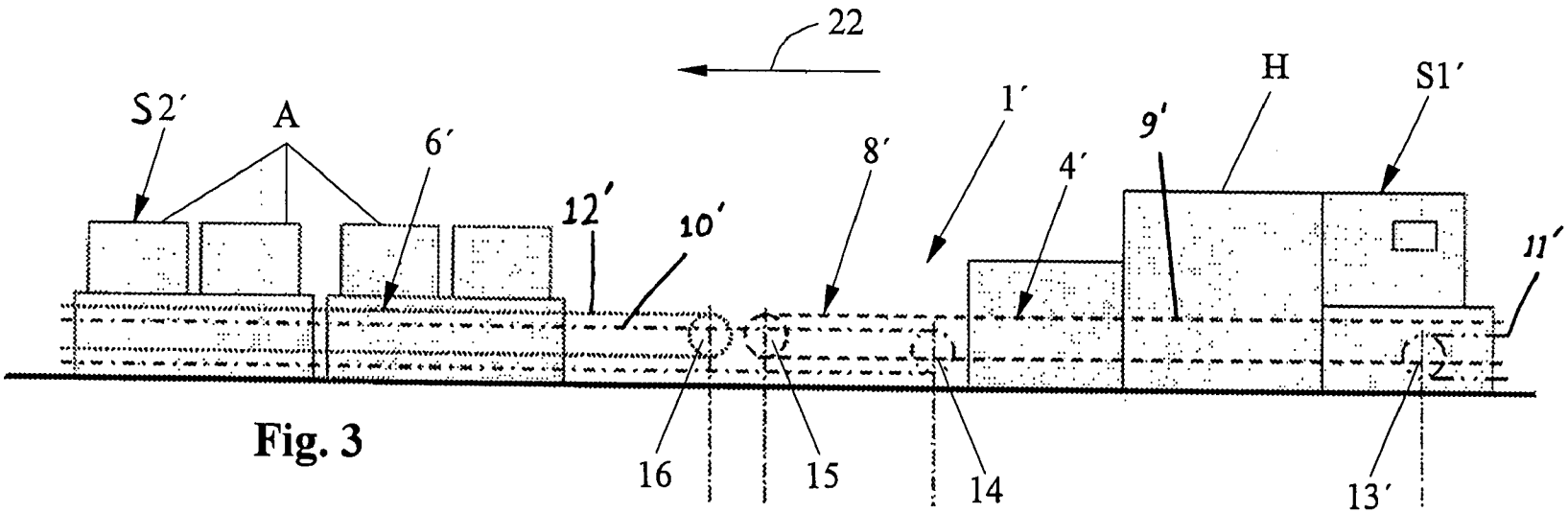
FIG. 3 shows a schematic view of a variant of the arrangement according to the invention.
Figure 4:
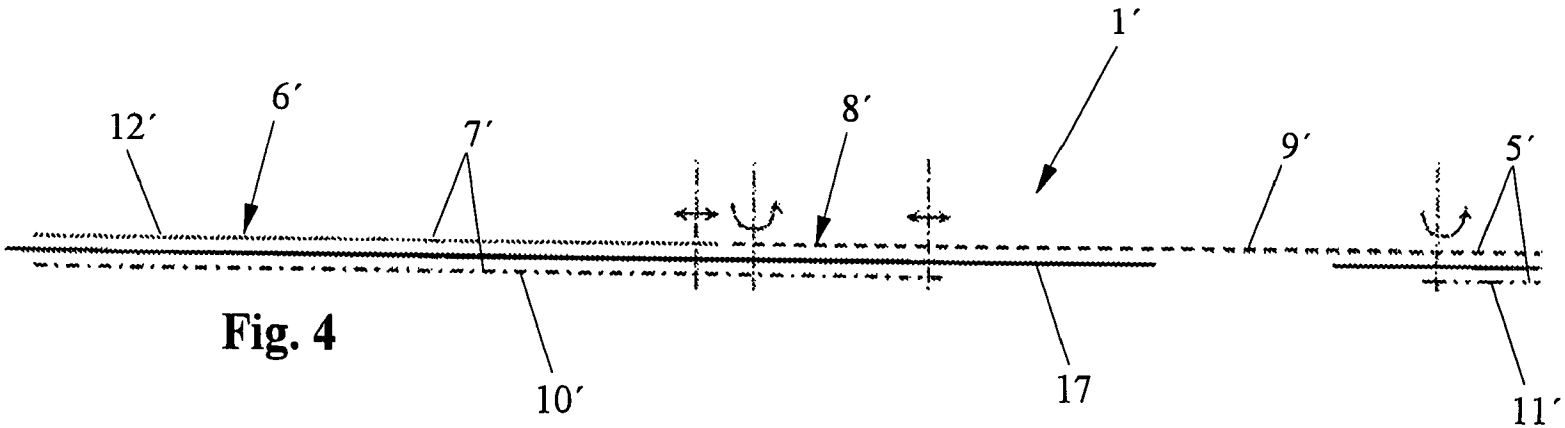
FIG. 4 shows a schematic view from above of the arrangement shown in FIG. 3.

Referring to FIGS. 3 and 4, there is shown an exemplary arrangement 1' which is a modification of the embodiment shown in FIGS. 1 and 2. This modification is provided with a first gathering and stitching machine S1', a transfer region 8', and a second gathering and stitching machine S2'. The first gathering and stitching machine S1, comprises a first conveying device 4' with a first strand 9' and a second strand 11'. The ridge 17 extends between these two strands 9' and 11' and is interrupted, in the same way as for the arrangement 1, in the region of stitching machine H. In addition, the strand 11' ends in front of the stitching machine H and is correspondingly also fitted around a drive wheel 13'. A second conveying device 6' is provided with a second double chain 7', having a strand 101 and a strand 121. The strand 10' corresponds to the aforementioned strand 10 and is fitted at the start of the transfer region 8' around the deflection pulley 14, causing the strand 10' to extend into the transfer region 8'. The strand 9' also extends into the transfer region 8' and is fitted around the drive wheel 15. The strand 9' thus corresponds to the above-mentioned strand 9. For this embodiment, the print products 2 are transported only by the strand 9' in the region of the stitching machine H. For this embodiment, the above-mentioned pivoting away of the carriers 18 occurs in the region of the drive wheel 13' and thus prior to the arrival at the stitching machine H.

Referring again to FIGS. 1 and 2, the print products 2 which are transported with the arrangement 1, for example gathered sheets or pre-stitched products, are transferred in four stages to the gathering and stitching machine S2. In the region of drive wheel 13, the carriers 18 of the strand 11 dip down and for a brief period, the items are transported only by the carriers 18 on the strand 9. In the second stage, the carriers 18 on the strand 10 appear, so that subsequently the print products 2 are transported with the aid of the two strands 9 and 10. In the region of the drive wheel 15, the carriers 18 of the strand 9 dip down, so that only the strand 10 transports the print products for a brief period. In the region of the deflection pulley 16, the carriers of the strand 12 appear, so that in the region of the second gathering and stitching machine S2, the carriers 18 on the strands 10 and 12 subsequently transport the print products 2.

The above-described four stages are also used for the transport with the arrangement 1', shown in FIGS. 3 and 4, wherein the first step is realized already in the region of the drive wheel 13' and thus prior to reaching the stitching machine H. In addition, the region in which only the strand 9' is used for the transport is considerably longer. In the transfer region 8', however, the transport here also occurs with the aid of two strands 9' and 10', as well as the guidance of the ridge 17.

It will be understood that the above description of the present invention is susceptible to various modifications, changes and adaptations, and the same are intended to be comprehended within the meaning and range of equivalents of the appended claims.

What is claimed is:

1. An arrangement for gathering and transporting print products, deposited straddling on a conveying device, comprising:

a first conveying device including a first double chain having first and second strands;

a second conveying device including a second double chain having first and second strands;

a transfer region in which the print products are transferred from the first conveying device to the second conveying device; and a guide extending continuously across the transfer region from the first conveying device to the second conveying device, the guide adapted to guide the print products positioned straddling in the conveying direction;

wherein the first and second double chains overlap in the transfer region such that in the transfer region the print products are transported with the aid of one of the strands on the first double chain and one of the strands on the second double chain.

2. The arrangement as defined in claim 1, wherein the guide comprises a ridge arranged between the first and second strands of the first and second double chains, respectively and extends across the transfer region.

3. The arrangement as defined in claim 1, wherein in the transfer region, the one strand of the first double chain and the one strand of the second double chain each include carriers and are arranged so that each print product is respectively transported by a carrier on the one strand of the first double chain and a carrier of the one strand of the second double chain.

4. The arrangement as defined claim 3, wherein the carriers on the strands of the first and second conveying devices overlap in the transfer region.

5. The arrangement as defined in claim 1, wherein the one strand of the first double chain and the one strand of the second double chain run parallel to each other and with synchronized timing.

6. The arrangement as defined claim 1, further comprising a first gathering and stitching machine associated with the first double chain and a second gathering and stitching machine associated with the second double chain, wherein the transfer region is formed with the aid of the first and second double chains.

7. The arrangement as defined in claim 6, wherein the two gathering and stitching machines are operable separately or jointly by tandem operation.

8. The arrangement as defined in claim 1, wherein each of the strands are tensioned and adjusted separately.

9. The arrangement as defined in claim 1, wherein the first strand of the first conveying device and the second strand of the second conveying device end before entering the transfer region, and the second strand of the first conveying device and the first strand of the second conveying device extend into the transfer region.

10. The arrangement as defined in claim 9, wherein the second strand of the first conveying device and the first strand of the second conveying device overlap in the conveying direction.

* * * * *